United States Patent [19]

Hodgskiss

[11] 4,079,609

[45] Mar. 21, 1978

[54] CONTROL SYSTEM FOR MULTIPLE STAGE REDUCING APPARATUS

[75] Inventor: Brian J. Hodgskiss, Southampton, England

[73] Assignee: Amtel, Inc., Providence, R.I.

[21] Appl. No.: 770,261

[22] Filed: Feb. 18, 1977

[30] Foreign Application Priority Data

Dec. 14, 1976 United Kingdom ..... 52057/76

[51] Int. Cl.[2] ..... B21C 1/12

[52] U.S. Cl. ..... 72/6; 72/289; 72/279

[58] Field of Search ..... 72/6, 8, 19, 289, 279, 72/9–12

[56] References Cited

U.S. PATENT DOCUMENTS

| | | | |
|---|---|---|---|
| 3,688,546 | 9/1972 | Tranier | 72/289 |
| 3,798,940 | 3/1974 | Frostick | 72/8 |

*Primary Examiner*—Milton S. Mehr

*Attorney, Agent, or Firm*—Prutzman, Hayes, Kalb & Chilton

[57] ABSTRACT

A control system for a multi-stage reducing apparatus having a series of material reducing stages through which elongate material is continuously advanced and progressively reduced in cross section. The control system is settable for establishing voltage analog signals representing the cross sections of the material at the plurality of successive stages and an input speed control signal for establishing the speed of the apparatus. A plurality of analog arithmetic units connected for being operated by the cross section signals and the speed control signal provide a plurality of speed reference signals for controlling the speeds of the material at the plurality of reducing stages respectively, each speed reference signal being directly proportional to the speed control signal and to the ratio of the cross sectional area of the material at the final stage to the cross sectional area of the material at the respective stage.

10 Claims, 4 Drawing Figures

CONTROL SYSTEM FOR MULTIPLE STAGE REDUCING APPARATUS

BRIEF SUMMARY AND BACKGROUND OF THE INVENTION

The present invention relates to a control system for a multi-stage reducing apparatus through which elongate material is advanced and reduced in cross section. The invention is particularly suitable for use in connection with apparatus, e.g., metal strip rolling mills and wire drawing machinery, having a series of material reducing stages through which elongate material is continuously advanced and progressively reduced in cross sectional area.

It is known in the prior art to reduce the cross section of elongate metal material by advancing the material through successive stages of multi-stage reducing apparatus. Each stage includes a material advancing mechanism and an opening of smaller size than the cross section of the material advanced to the stage. The openings at successive stages of the apparatus are progressively smaller in size so that the cross section of the material is progressively reduced as the material is advanced. When the material leaves the opening of the final material reducing stage, it has the desired cross sectional shape and size. Multi-stage rolling mills and multi-stage wire drawing machines represent examples of this general type of equipment.

As a result of the reduction in cross sectional area of the material at each opening, the material experiences an elongation in passing through each opening. Consequently, it is necessary for the material advancing mechanisms at the successive stages of the reducing apparatus to operate at progressively increasing speeds from the initial to the final stage.

When operation of such multi-stage reducing apparatus is initiated from rest, it is necessary for the prime movers, e.g., electric drive motors, of the material advancing mechanisms to be operated at desired fixed relative speeds during the acceleration period to avoid possible breakage or the production of excessive material between the material reducing stages. The same fixed proportional relationship of material speeds at the various stages is required in the operation at normal running speed for the same reasons. Consequently, it is essential for successful operation of such multi-stage reducing apparatus to provide precise regulation of the speed of the material at each of the material reducing stages.

Control arrangements for multi-stage reducing apparatus have been previously proposed to allow an operator to preset the desired ratio of speeds between the material advancing mechanisms of the reducing stages. An example of one such arrangement is described in U.S. Pat. No. 3,688,546, issued on Sept. 5, 1972 to Jean Tranier. This patent discloses a speed control arrangement for a multi-stand reducing apparatus in which a dial or rule associated with each stand is provided with a logarithmic scale for representing the size, i.e., diameter, of the material at each stand. The dials are coupled together to provide equal movement of all dials simultaneously. The logarithmic scales on the dials are progressively offset relative to the dial associated with the final stage, with the progressive offset between the dials corresponding on a logarithmic scale to the base speed ratios between the material reducing stands. The machine operator must visually align the logarithmic scales on the dials with a series of hairlines to obtain desired size settings. A general speed signal is applied across a parallel array of voltage dividers, one for each stand, with a pickup for each divider arranged to supply its associated drive motor with a speed control voltage dependent on the general speed control signal and the position of the pickoff along its divider. Each pickoff, other than the final or finisher stand, is adjustable through a limited range to provide an approximately linear relationship between voltage changes and the logarithmic scale.

Because of the necessity for an operator to manipulate the dials relative to visual hairlines, it is difficult to obtain accurate material size settings on such a control mechanism. Since all dials are coupled together for simultaneous movement, the control arrangement does not permit any flexibility in the section of relative material size settings at the various stands. In addition, because of the limited range of adjustment of the voltage dividers required to preserve the necessary linear relationship between the voltage changes and logarithmic scale, the range of material size settings is restricted.

A primary objective of the present invention is to provide an improved system for controlling a multi-stage reducing apparatus to achieve more precise speed control of the material at the material reducing stages. Another object of the invention is to provide a control system for a multi-stage reducing apparatus which is conveniently and accurately operable over a wide range of material sizes. It is also a purpose of the invention to achieve a multi-stage reducing apparatus in which the material speed at each of the reducing stages is accurately controlled according to the material speed at a predetermined stage and the ratio of the cross sectional areas of the material at the predetermined stage and the particular stage.

In accordance with the present invention, a control system for a multi-stage reducing apparatus having a series of material reducing stages through which elongate material is continuously advanced and progressively reduced in cross section comprises means for generating a set of signals representing the cross sections of the material at each of the stages, means for generating a speed control signal representative of the speed of the material at one stage, and control means responsive to the cross section signals and the speed control signal and operable for producing a plurality of speed reference signals for controlling the speed of the material at each stage, each such reference signal being proportional to the speed control signal and the ratio of the cross section of the material at said one stage and the cross section of the material at the respective stage. The control means is preferably embodied as a plurality of analog arithmetic units, for the plurality of stages, each responsive to the speed control signal and to the cross section signals of said one stage and the respective stage and operable for generating an output signal corresponding to the product of the speed control signal and the ratio of the cross sections of the material.

A preferred embodiment of the invention may be embodied as a multi-stage wire drawing apparatus for advancing and drawing continuous wire material stock and comprising a series of material drawing stages each including a rotatable draw block for advancing the wire material stock, a drive motor for rotating the draw block to advance the wire material stock and a die having an opening for reducing the cross sectional area of the wire stock.

It will be understood that the term "opening" used herein encompasses both the spacing between rolls in a metal strip rolling mill and the bore in a die of a wire drawing machine. However, the term "opening" is not intended to limit the scope of the present invention to only those types of reducing machines. In addition, the preferred embodiment may include a gear train at each stage for connecting its drive motor to its respective rotatable block, and means for modifying the speed reference signals to compensate for the different gear ratios.

The present invention also contemplates a method of controlling a multi-stage reducing apparatus having a series of material reducing stages through which elongate material is continuously advanced and progressively reduced in cross section and wherein each stage has a drive unit for advancing the material at a speed determined by an applied signal. The method comprises generating a first signal representing the cross section of the material at one of the stages, generating a set of second signals representing the cross sections of the material at each of the other stages, applying a speed signal to the drive unit at the one stage to control the speed of the material at that stage, combining the first signal with each of the second signals and with the speed signal to produce a plurality of reference signals proportional to the speed signal and the respective ratios of the cross section of the material at the one stage to the cross sections of the material at each of the other stages, and applying the reference signals to the other drive units to control the speed of the material at each of the other stages.

The present invention achieves a system and method of controlling the operation of a multi-stage reducing apparatus in which the speed of the material at each reducing stage is precisely controlled. In addition, the invention is readily adaptable to control a multi-stage reducing apparatus over a wide range of material size.

Other objects will be in part obvious and in part pointed out more in detail hereinafter.

A better understanding of this invention will be obtained from the following detailed description and the accompanying drawings of an illustrative application of the invention.

DESCRIPTION OF THE PREFERRED EMBODIMENT

Figure 1:
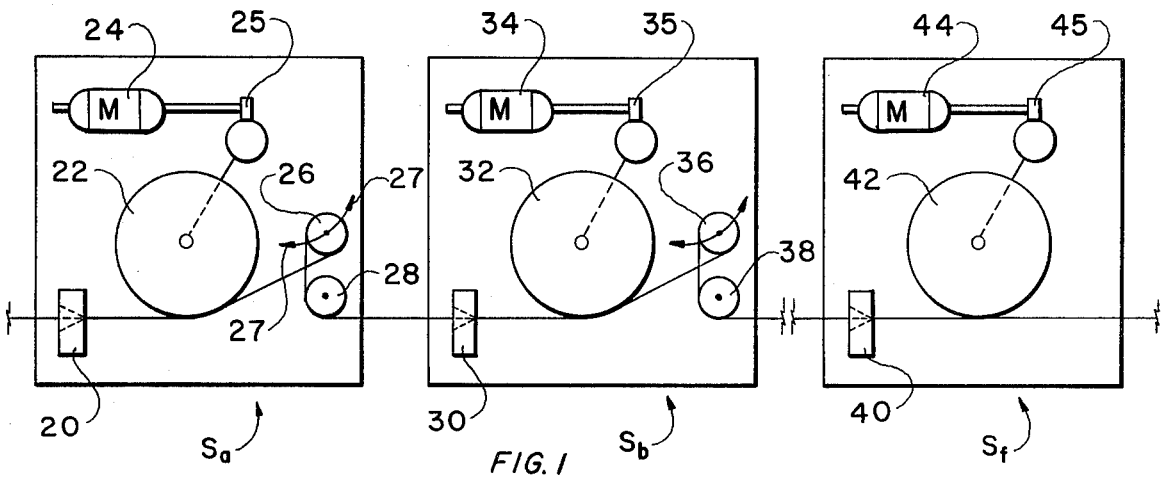
FIG. 1 is a diagrammatic illustration of a multi-stage wire drawing machine controlled in accordance with the system and method of the present invention.

Referring to FIG. 1, a conventional multi-stage wire drawing apparatus includes a series of consecutive reducing stages $S_a$, $S_b$, . . . $S_f$ through which a wire 10 is continuously advanced and progressively reduced in cross section. Although, for purposes of illustration, only three stages are shown in FIG. 1, it is understood that any desired number of reducing stages can be employed with the control system of the present invention. In addition, although the invention is specifically described in the context of a wire drawing machine, it should be appreciated that the invention is also applicable to rolling mills and other similar apparatus.

The initial stage $S_a$ includes a drawing die 20 having an opening for receiving a wire 10 for reducing its cross sectional area. This stage also includes a rotatable draw block 22 for drawing the wire in a conventional manner through the die 20. The draw block 22 is driven by a drive motor 24 via a gear train 25. In addition, the initial stage $S_a$ includes a suitable dancer mechanism having a dancer pulley 26, which is movable, as indicated by arrows 27, in a conventional manner to maintain the wire tension at a predetermined level and to adjust the speed of the motor 24 accordingly, and a fixed axis idler pulley 28 around which the wire is fed to the next stage.

The second drawing stage $S_b$ is substantially identical to the initial stage and includes a drawing die 30 having an opening for receiving the wire 10 for reducing its cross sectional area, a rotatable draw block 32 for drawing the wire, a drive motor 34 for rotating the draw block via a gear train 35, a dancer pulley mechanism with a dancer pulley 36 and a fixed axis idler pulley 38. The final drawing stage $S_f$ includes a drawing die 40 having an opening for receiving the wire to reduce its cross sectional area, a rotatable draw block 42 for drawing the wire, and a drive motor 44 for rotating the block via a gear train 45. The final stage does not require a dancer pulley.

As shown in FIG. 1, in the drive unit of each material reducing stage, the rotatable draw block is driven by a separate drive motor, e.g., a DC electric motor. The speed of each motor is finely controlled within, for example, $\pm 10\%$ by the dancer pulley to maintain wire tension and to finely tune the speed relationships of the successive stages required by the reduction in cross sectional area performed by the dies. The gear trains 25, 35, 45 which couple the drive motors, 24, 34, 44 to the rotatable draw blocks, 22, 32, 42 have gear ratios which are hereinafter designated $G_a$, $G_b$ and $G_f$ respectively.

Figure 2:
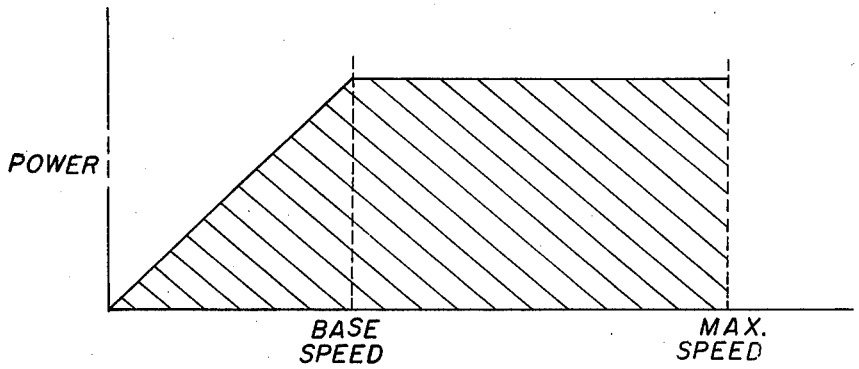
FIG. 2 is a graph illustrating the power and speed characteristics of a drive motor associated with each stage of the machine.
Figure 3:
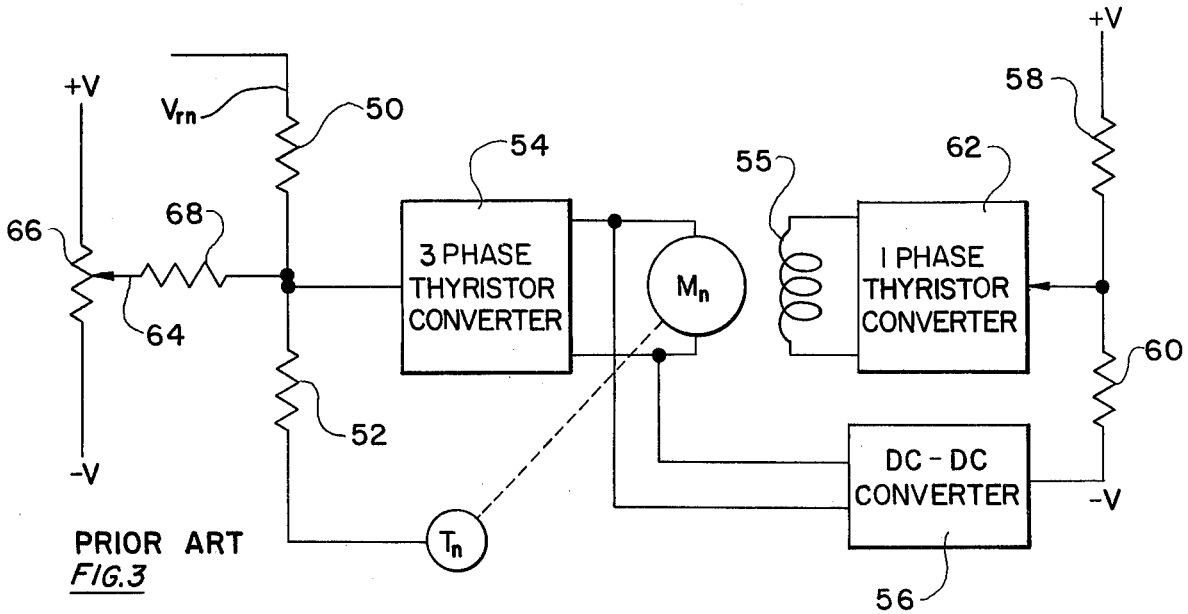
PRIOR ART FIG. 3
FIG. 3 is a block diagram of a conventional control circuit used to control the speed of the drive motor at each stage of the machine.

The circuit shown in FIG. 3 represents a conventional motor control circuit for controlling a DC motor. The same circuit can be employed at the initial stage and each intermediate stage of the apparatus. Substantially the same circuit is employed at the final stage with the exception that the dancer pulley control is not employed. The control circuit allows each drive motor to develop a combination of speed and power anywhere within the envelope (shaded area) of the graph shown in FIG. 2.

In operation, a speed reference voltage generally designated $V_{rn}$ (and specifically designated for example $V_{rb}$ for the second stage) is applied via a voltage divider circuit comprising a pair of resistances 50 and 52 to a 3-phase thyristor converter circuit 54 which develops a 3-phase voltage for the armature of the drive motor $M_n$, for example the motor $M_b$ of the second stage $S_b$. The voltage for the field coil 55 of the drive motor is derived from the 3-phase output voltage of converter 54 via a DC-DC converter 56 having its output applied across a voltage divider comprising a pair of resistances 58 and 60 to a 1-phase thyristor converter circuit 62. A tachometer $T_n$, for example a tachometer $T_b$ of the intermediate stage $S_b$, provides a feedback signal to the converter circuit 54 via the resistance 52.

The dancer pulley, e.g., pulley 36 (FIG. 1) of the second stage $S_b$, is coupled to a dancer arm 64 (FIG. 3) which moves along a potentiometer 66 and applies a variable voltage via a coupling resistance 68 to the junction of resistances 50 and 52 in response to movement of the dancer pulley. It is understood that similar arrangements are included in the motor control circuits of the other stages, with the exception of the final stage which does not require a dancer pulley speed trim control.

The control circuit of FIG. 3 provides that the speed of each stage drive motor is directly proportional to the corresponding stage speed reference voltage $V_{rn}$ when the respective dancer arm 64 is located at the mid-point of its travel along the potentiometer 66. The reference voltage $V_{rn}$ is established as hereinafter described and whereby for example the reference voltage $V_{rb}$ of the second stage $S_b$ provides a speed of the respective stage drive motor $M_b$ which is approximately correct for that stage. The dancer arm provides a relatively limited, for example up to a ±10% speed correction compensation for die inaccuracy and wear and fluctuation in stock hardness, etc. for maintaining the correct wire speed ratios between successive stages.

In the preferred embodiment of the invention disclosed herein, the speed reference voltage $V_{rn}$ employed for the drive motor of each material reducing stage is generated by the control system so that the reference voltage $V_{rn}$ of any stage $S_n$ is proportional to (a) the reference voltage $V_{rf}$ of the final stage $S_f$, (b) the ratio of the square of the diameter of the die opening $D_f$ of the final stage $S_f$ to the square of the diameter of the die opening $D_n$ of the particular stage, (c) the ratio of the gear ratio $G_n$ of the particular stage to the gear ratio $G_f$ of the final stage, (d) the ratio of the reference voltage $V_{rn}$/motor RPM conversion ratio $K_n$ of the particular stage $S_n$ to the reference voltage $V_{rf}$/motor RPM conversion ratio $K_f$ of the final stage $S_f$, and (e) the ratio of the block diameter $BD_f$ of the final stage to the block diameter $BD_n$ of the particular stage $S_n$, i.e., $$V_{rn} = V_{rf} \cdot \frac{D_f^2}{D_n^2} \cdot \frac{G_n}{G_f} \cdot \frac{K_n}{K_f} \cdot \frac{BD_f}{BD_n}$$

That relationship is derived from an equation based on the fact that the volumetric flow of material through the die at each stage remains constant, i.e., $$VEL_n = VEL_f \cdot \frac{D_f^2}{D_n^2} \tag{1}$$

where $VEL_n$ is the peripheral velocity of the draw block at stage $S_n$ and $VEL_f$ is the peripheral velocity of the draw block at the final stage $S_f$. The peripheral speed of the draw block at stage $S_n$ is determined in accordance with the formula:

$$VEL_n = BN_n \cdot \pi \cdot BD_n \tag{2}$$

where $BN_n$ is the RPM of the draw block of stage $S_n$.

The draw block speed $BN_n$ at stage $S_n$ is equal to the motor speed $N_n$ divided by the gear ratio $G_n$, i.e., $$BN_n = \frac{N_n}{G_n} \tag{3}$$

By definition:

$$K_n = \frac{V_{rn}}{N_n} \tag{4}$$

From equations (1) and (2), it follows that $$VEL_n = \frac{\pi \cdot BD_n \cdot V_{rn}}{G_n \cdot K_n} \tag{5}$$

$$V_{rn} \cdot \frac{\pi \cdot BD_n}{G_n \cdot K_n} = V_{rf} \cdot \frac{\pi \cdot BD_f}{G_f \cdot K_f} \cdot \frac{D_f^2}{D_n^2} \text{ or}$$

$$V_{rn} = V_{rf} \cdot \frac{D_f^2}{D_n^2} \cdot \frac{G_n}{G_f} \cdot \frac{K_n}{K_f} \cdot \frac{BD_f}{BD_n}$$

In the preferred embodiment of this invention, a signal $V_c$ is supplied, such that $$V_{rf} = V_c \cdot \frac{G_f \cdot K_f}{BD_f}$$

Therefore:

$$V_c = V_{rf} \cdot \frac{BD_f}{G_f \cdot K_f}$$

and using this signal we can restate equation (5) as $$V_{rn} = \left( V_{rf} \cdot \frac{BD_f}{G_f \cdot K_f} \right) \frac{D_f^2}{D_n^2} \cdot \frac{G_n \cdot K_n}{BD_n}$$

Therefore:

$$V_{rn} = V_c \cdot \frac{D_f^2}{D_n^2} \cdot \frac{G_n \cdot K_n}{BD_n}$$

From this analysis, it will be seen that in order to get the desired relationship between wire speeds at the various stages of the machine, it is necessary for the motor speed of the stage $S_n$ to be related to the motor speed of the final block by the ratio ($D_f^2/D_n^2$), i.e., to the ratio of the cross sectional areas of the material at the final stage $S_f$ and the $n^{th}$ stage $S_n$. If the gear ratios $G_n$ and $G_f$ or block diameters $BD_n$ and $BD_f$ are not the same, it is also necessary to factor in the gear ratios and block diameter ratios to obtain the desired motor speed relationship.

Figure 4:
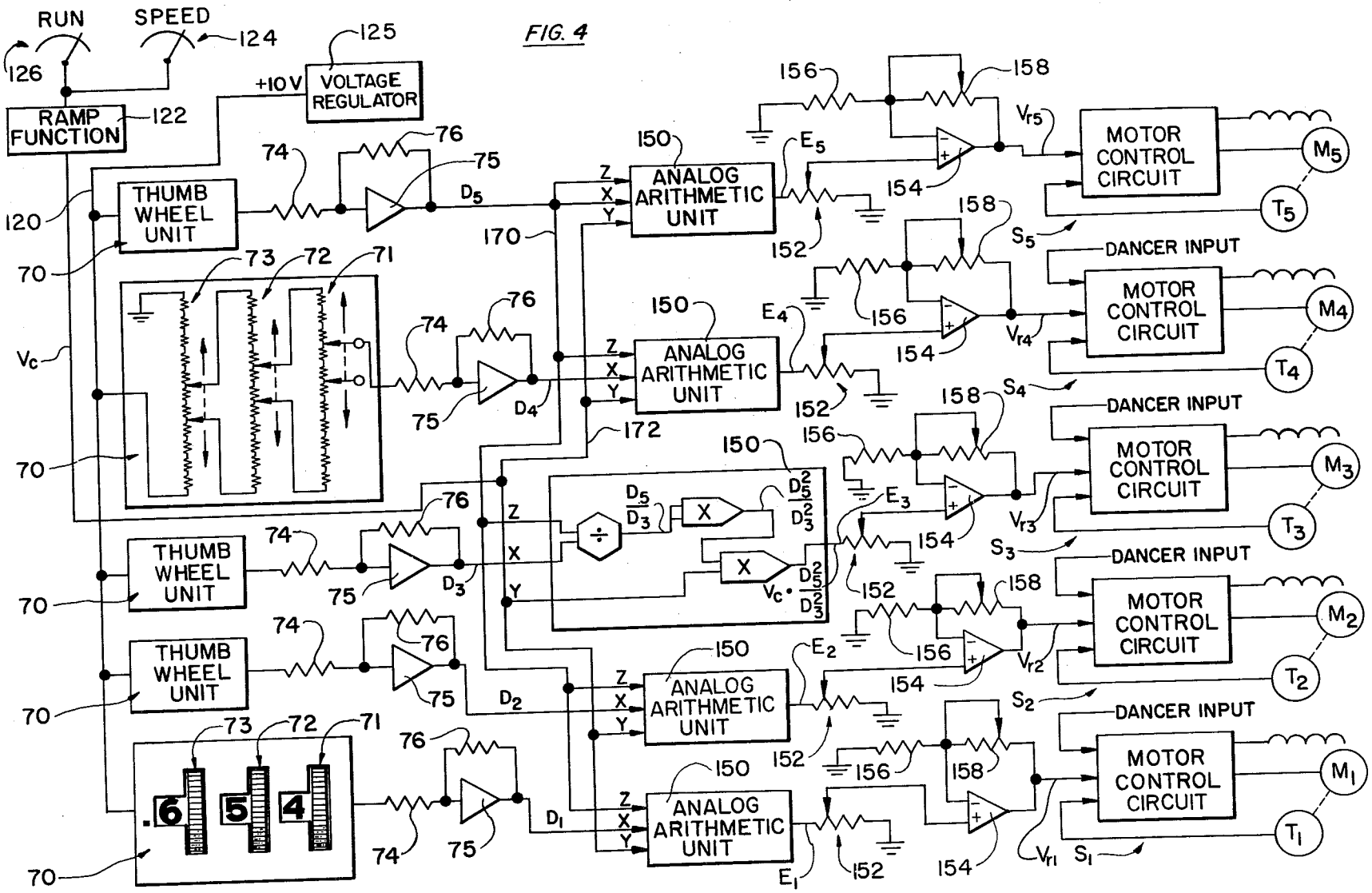
FIG. 4 is a schematic diagram of a control system constructed in accordance with the present invention for controlling the multi-stage reducing apparatus of FIG. 1.

Referring to FIG. 4, an electronic control circuit is provided for controlling the drive motors of the material reducing stages to achieve the desired relationship between the motor speeds as described in the above analysis. For purposes of illustration, the specific control system shown is adapted for use with a five-stage wire drawing machine having five successive wire drawing stages designated $S_1$, $S_2$, $S_3$, $S_4$, and $S_5$. Stage $S_5$ represents the final stage of the apparatus. Although the specific control circuit utilizes analog voltage signals having voltage magnitudes which correspond to motor speeds, cross sectional areas or ratios, it is contemplated that the same control function could be achieved by a circuit which operates on digital signals.

In accordance with the invention, the control system includes means for generating analog voltage signals representing the cross sections of the material at the successive stages. Preferably, the control circuit of FIG. 4 incorporates a suitable manually adjustable thumb switch voltage divider 70 for each stage and which has for example three manually settable decades 71–73 of increasing order respectively which permit the machine operator to establish a three place setting, to three decimal places, of the diameter of the die opening of the respective stage. Thus, the thumb switch 70 provides for establishing a digital setting within a wide range of diameter settings for producing an output signal having a voltage directly proportional to the diameter of the respective stage die opening. The thumb switch output voltage signal is applied via a coupling resistance 74 to an amplifier 75 with feedback resistance 76. The amplifier provides an output voltage signal $D_n$ directly proportional to the thumb wheel setting and therefore the diameter of the respective stage die opening. Feedback resistance 76 is provided to eliminate the effect of any internal voltage or characteristic changes on the amplifier operation. Output signal $D_n$, which is directly proportional to the diameter of the die opening, represents a cross section dimension of the material at the respective stage $S_n$.

Thus, the control system includes five thumb switch voltage dividers 70, which are preferably substantially identical, for generating a set of wire or die opening cross section signals representing the diameters of the drawing die openings at the five stages $S_1$–$S_5$. As indicated, the manually adjustable thumb switch 70 of each stage is set to correspond to the diameter of the die opening of the respective stage. Each thumb switch is connected to a common input line 120 having a fixed line voltage, shown to be +10 volts, established by a suitable voltage regulator 125.

The speed control system comprises a ramp function generator 122 that is supplied with a desired voltage under the control of a speed control switch 124 that is used to establish the speed of the multiple stage drawing apparatus and in the shown embodiment the speed of the final stage motor $M_5$. Also, a run switch 126 is provided which functions as an on-off control switch. The ramp function generator 122 is employed in a conventional manner for controlling the multi-stage reducing apparatus so that it gradually accelerates to the speed established by the speed control switch 124.

The control system includes means for generating speed reference voltage signals $E_1$–$E_5$ representative of the speeds of the material at the plurality of successive stages $S_1$–$S_5$. The output voltage $D_n$ of amplifier 75 that represents the cross section of the material at stage $S_n$ is applied via a fixed function analog arithmetic unit or computing unit 150 and a potentiometer 152 to the non-inverting input of an operational amplifier 154. The purpose of potentiometer 152 is to modify the output signal $E_n$ of the computing unit 150 in accordance with the gear ratio $G_n$ of the gear train at the respective stage $S_n$ and also the ratios (if other than unity) of the conversion ratio $K_n$ and block diameter $BD_n$ of the respective stage $S_n$ to that of the final stage $S_f$. A feedback loop including a grounded resistance 156 and a variable resistance 158 is provided at each stage between the output of amplifier 154 and its inverting input to allow the gain of the amplifier to be adjusted. The output voltage provided by amplifier 154 is employed as a speed control or reference signal $V_{rn}$ which is applied to the motor circuit for the respective stage $S_n$. Thus, the final stage speed reference signal $V_{r5}$ is proportional to the motor speed and therefore also the wire speed at the final stage.

The analog arithmetic unit 150 provides for computing $E_n$ in accordance with the formula $$E_n = V_c \frac{D_f^2}{D_n^2}$$

and the amplifier-resistor network, 152, 154, 156, and 158 provides for computing $V_{rn}$ in accordance with the formula $$V_{rn} = E_n \cdot \frac{G_n \cdot K_n}{BD_n}$$

to provide the proper signal to the motor control circuit.

More particularly, each stage arithmetic or computing unit 150 provides control means which is responsive to the voltage analog signal $D_n$ representative of the cross section of the material at that stage, the voltage analog signal $D_f$ representative of the cross section of the material at the last stage $S_f$, and the speed control signal $V_c$ from the ramp function generator 122, and is operable for producing a speed reference signal $$E_n = \frac{D_f^2}{D_n^2} \cdot V_c$$

for controlling the speed of the material at the respective stage. Since it will be seen that the speed reference signal $E_5$ for the final stage $S_5$ will equal $V_c$, the speed reference signal $E_n$, of each prior stage is proportional to the speed signal $V_c$ and to the ratio of the cross sectional area of the wire at the final stage to the cross sectional area of the material at the particular stage.

Preferably, as shown, there is a separate computing unit 150 for each stage, responsive to the respective stage dimension signal $D_n$, the speed control signal $V_c$, and to the final stage dimension signal $D_f$, for generating an output speed signal $E_n$ corresponding to the product of the speed control signal $V_c$ and the respective ratio of the cross sectional areas.

Each computing unit 150 may for example be a model 4302 multi-function converter manufactured by Burr-Brown of Tuscon, Arizona, and appropriately hard-wired to perform the desired computation function described. Each such converter has a "Z" input connected to receive the $D_5$ dimension output signal from the final stage amplifier 75 via a common input line 170 and a "Y" input connected via a common input line 172 to receive the $V_c$ speed control signal from the ramp function generator 122. An "X" input of the converter 150 is connected to receive a dimension output signal $D_n$ from the respective stage amplifier 75. Each computation unit 150 is hard-wired to produce an output voltage signal $E_o$ in accordance with the formula $$E_o = V_y \cdot \frac{V_z^2}{V_x^2}$$

where $V_x$, $V_y$ and $V_z$ are the respective voltages applied to the "X", "Y" and "Z" inputs of the converter 150. Thus, the output signal $E_4$ produced by the fourth stage computation unit 150 has a voltage substantially equal to $V_c \cdot (D_5^2/D_4^2)$. Similarly, the output signal $E_3$ produced by the third stage computation unit 150 is equal to $V_c \cdot (D_5^2/D_3^2)$; the output signal $E_2$ produced by the second stage computation unit 150 is equal to $V_c \cdot (D_5^2/D_2^2)$; and the output signal $E_5$ produced by the final stage computation unit 150 is equal to $V_c \cdot (D_5^2/D_5^2)$ or $V_c$.

Accordingly, in the specific embodiment of the control system which is shown, the final stage computation unit 150 is unnecessary and the $V_c$ output signal from the ramp function generator 122 can be employed as the input signal to the final stage resistor 152. However, the final stage computation unit 150 is preferably provided as shown so that all of the individual stage systems are substantially identical and to thereby simplify the installation, repair and maintenance of the control system in the field.

If desired, the dancer trim circuits can be replaced by a different type of automatic speed trim system or by suitable manually operated speed trim circuits connected like the dancer trim circuits as shown in FIG. 3 or in the alternative connected for modifying the dimension voltage output signals $D_1$–$D_5$ from the thumb wheel voltage dividers 70. Or each thumb wheel voltage divider may be used for manually trimming the speed of the respective draw block.

If desired, each set of thumb wheels 71–73 may be preset to the cross sectional area of the material at the respective material reducing stage, in which event, a multiplication/division type of arithmetic unit would be provided in place of the described arithmetic unit 150 in order to provide an arithmetic unit output signal having a voltage $E_n = V_c \cdot (D_f^2/D_n^2)$ as described.

The control system and method of the present invention provide for extremely accurate control of the material speed at each of the successive stages of the multi-stage reducing apparatus. In addition, the invention is readily adaptable for use with multi-stage reducing apparatus over a wide range of cross sections of material to be reduced.

As will be apparent to persons skilled in the art, various modifications, adaptations and variations of the foregoing specific disclosure can be made without departing from the teachings of this invention.

I claim:

1. A speed control system for a multiple stage reducing apparatus having a plurality of successive material reducing stages through which elongate material is continuously advanced and progressively reduced in cross sectional area, comprising manually settable means settable for generating a plurality of separate reducing stage signals representing the relative cross sectional areas of the material at the plurality of reducing stages respectively, means for generating a speed control signal, and circuit means responsive to the plurality of separate reducing stage signals and the speed control signal and operable for producing a plurality of speed reference signals for the plurality of reducing stages respectively operable for controlling the relative speeds of the material at the respective stages, the plurality of speed reference signals being proportional to the ratios respectively of the cross sectional area of the material at one predetermined stage of the reducing apparatus to the cross sectional areas of the material at the plurality of reducing stages respectively.

2. The speed control system of claim 1 wherein said circuit means comprises an arithmetic unit for at least each of the reducing stages of the reducing apparatus excepting said one predetermined stage, each responsive to the reducing stage signals of the corresponding reducing stage and of said one predetermined stage and to the speed control signal and operable for producing the respective speed reference signal.

3. The speed control system of claim 1 wherein the speed reference signals are proportional to the respective products of said speed control signal and said ratios.

4. The speed control system of claim 1 wherein said one predetermined stage is the final reducing stage of the apparatus.

5. The speed control system of claim 1 wherein the circuit means is operable for producing a said speed reference signal for said one predetermined reducing stage which is proportional to said speed control signal.

6. A multiple stage drawing apparatus for advancing and progressively reducing the cross sectional area of elongated material, comprising a plurality of successive material drawing stages each having a die for reducing the cross sectional area of the elongated material, a rotatable draw block for drawing the material through the die at an exit draw speed dependent on the speed of the draw block and a variable speed drive motor for rotating the draw block; first manually settable means settable for generating a first die size signal of the size of the die at one predetermined drawing stage of the apparatus; second manually settable means settable for generating a set of second die size signals of the sizes of the dies at the remaining drawing stages respectively; speed control means for generating a speed control signal; circuit means responsive to the first die size signal, each of the second die size signals and the speed control signal and operable for producing a plurality of speed reference signals for said remaining stages respectively which are directly proportional to the ratios respectively of the die size area of said one predetermined stage to the die size areas of the respective drawing stages, and motor control means for controlling the speed of the drive motor at said one predetermined drawing stage in accordance with said speed control signal and at each said remaining drawing stage in accordance with the respective speed reference signal and so that the relative exit draw speeds at the successive drawing stages are substantially inversely proportional to the cross sectional areas of the drawn material at the respective drawing stages.

7. The multiple stage drawing apparatus of claim 6 further comprising a reduction drive at each stage for connecting the drive motor to the respective draw block, at least some of the reduction drives having different reduction ratios, and wherein the motor control means comprises means for compensating for the different drive ratios.

8. The multiple stage drawing apparatus of claim 6 wherein said circuit means comprises a plurality of arithmetic units for said remaining drawing stages respectively, each responsive to the first die size signal, speed control signal and to the respective second die size signal and operable for generating the respective speed reference signal in accordance with the product of the speed control signal and the ratio of the die size area of the die at said one predetermined drawing stage to the die size area of the die at the respective drawing stage.

9. The multiple stage drawing apparatus of claim 6 wherein said one predetermined drawing stage is the final drawing stage of the apparatus.

10. A method of controlling a multiple stage reducing apparatus having a plurality of successive material reducing stages through which elongate material is continuously advanced and progressively reduced in cross section, each reducing stage having a drive unit for advancing the material at a speed determined by an applied signal, the method comprising the steps of generating a first signal in accordance with the cross section of the material at one predetermined reducing stage of the apparatus, generating a set of second signals in accordance with the cross sections of the material at the remaining reducing stages respectively, generating a speed control signal and applying it to the drive unit at said one predetermined reducing stage to control the speed of the material at said one stage, producing for each said remaining stage a speed reference signal in accordance with the first signal, the respective second signal and the speed control signal and so that the speed reference signal is proportional to the speed control signal and the ratio of the cross sectional area of the material at said one stage to the cross sectional area of the material at the respective stage, and applying each reference signal to the drive unit of the respective reducing stage to control the speed of the material thereat.

* * * * *